US005364101A

United States Patent [19]

Spooner et al.

[11] Patent Number: 5,364,101

[45] Date of Patent: Nov. 15, 1994

[54] CASINO DICE GAME METHOD

[76] Inventors: James J. Spooner; Kelley A. Spooner, both of 16203 E. Glendora Dr., Fountain Hills, Ariz. 85268-3108

[21] Appl. No.: 52,128

[22] Filed: Apr. 22, 1993

[51] Int. Cl.[5] ..... A63F 9/04

[52] U.S. Cl. ..... 273/146

[58] Field of Search ..... 273/146, 272

[56] References Cited

U.S. PATENT DOCUMENTS

| | | | |
|---|---|---|---|
| 4,469,329 | 9/1984 | Guyer | 273/146 |
| 4,648,602 | 3/1987 | Maroney | 273/146 |
| 4,834,386 | 5/1989 | Rosenthal et al. | 273/146 |

*Primary Examiner*—Benjamin H. Layno
*Attorney, Agent, or Firm*—Donald J. Lisa; Steven Lin

[57] ABSTRACT

A method is disclosed for playing a CASINO dice game with a set of six identical dice in which each die has a different symbol on each face. The symbol may be one of the letters of the same six lettered word CASINO or one of six different colors. A scoring system assigns a predetermined point value to individual symbols or combined symbols. A player must reach a threshold level of 1000 points and surrender his turn before rolling nothing of value for that player's points to count, failing which he loses his turn and all points accumulated during that turn. The players then continue to play until one player ends the game by reaching 10,000 points. That player may choose to surrender his turn and establish his final score as the winning high score or continue his turn to establish an even higher score, at the risk of losing his turn, his points for that turn, and the established winning score if he rolls nothing of value. Once the winning score is established, each of the other players are then given their last opportunity in turn to beat the prior winning score and themselves win the game. If any remaining player surpasses the present high score, he may choose either to end his turn or to continue his turn to establish an even higher winning score making it more difficult for any players to exceed during their last turn.

12 Claims, 1 Drawing Sheet

CASINO DICE GAME METHOD

BACKGROUND OF THE INVENTION

1. Fields of the Invention

The present invention relates generally to a method and apparatus for playing a dice game for at least two players, and, more particularly, to a game that uses six identical dice in which the letter or each of six faces of each die spells a six lettered word or has a different one of six different colors and scoring for the game is based on pre-assigned point values for each letter or color or combinations thereof.

2. Discussion of Background and Prior Art

Chance and casino type dice games are well known. Inventors Van R. and Maxine Goodman in U.S. Pat. No. 4,930,780 ("Goodman") disclosed a dice game played by two or more players with six ordinary dice in which there are three stages of the game. In the first stage of the game, each player throws the dice in turn and must both exceed a predetermined threshold and the prior player's score by a predetermined amount in order to enter a second stage of the game in which players begin to accumulate points. A player must voluntarily surrender his turn while still accumulating points in order for any accumulated points to be recorded as part of the player's score. If a player failed to score any points on a given throw, he loses his turn as well as any points accumulated during that turn. The final stage of the game occurs when one player reaches a predetermined high score, and the remaining players take their turn in sequence to try to exceed this score to win.

The method of the present invention distinguishes over the Goodman invention by not requiring a player to exceed the score of the previous player by a predetermined number of points to begin accumulating points and by using dice which include letters of the same six lettered word or one of six different colors.

Game apparatuses which use dice that comprise the letters of a six-lettered word placed on the faces of each die have also been known prior to the present invention. In U.S. Pat. No. 1,412,204, the inventor Lee M. Derby discloses a game apparatus comprising a set of six identical cubes with the faces of any one of the cubes having different letters which taken together in a certain order spell a complete word. The set of six dice may all be of one color. In U.S. Pat. No. 4,934,700, the inventor Alice N. Turek discloses a dice word game comprising twenty-four six-sided dice. Each side of each die is marked with a unique letter of a six-letter target word.

The present invention differs from the six letter word prior dice games in its simplified scoring method and in the use of six different colors or the particular six letter word CASINO.

Accordingly, it is another object of the present invention to provide a dice game which has a unique scoring system and which uses dice that bases scoring on the letters of a six-lettered word or colors.

It is another object of the present invention to provide a dice game apparatus and method in which the player is required to exceed a predetermined point threshold, but not the score of the previous player in order to accumulate points.

It is a further object of the present invention to provide more fun to the players by having them make more risk-taking decisions during the play of the game.

SUMMARY OF THE INVENTION

Set forth below is a brief summary of the invention in order to solve the foregoing problem and achieve the foregoing and other objects, benefits, and advantages in accordance with the purposes of the present invention as embodied and broadly described herein.

One aspect of the invention is a method of playing a dice game for at least two players which includes the steps of providing a set of six identical dice with a different symbol on each face of each die and a scoring system assigning a point value to the individual and combined symbols, determining the order of play by the value of the roll of the dice by each player, accumulating points for each player during his roll of the dice according to a predetermined scoring system which includes (1) beginning to record scores for each player in turn only after the player reaches a first predetermined number of points and surrenders his turn before he rolls nothing of value according to the scoring system, and ending the game when a player reaches a second predetermined number of accumulated points and each succeeding player thereafter in turn fails to either exceed that score or the highest score of any preceding player which exceeded that score or ends his turn by rolling nothing of value.

A further feature of this aspect of the invention is that each player will roll all of the dice for the initial roll and roll only those dice that show no point values for any secondary rolls.

A further feature of this aspect of the invention is that the scoring system comprises letters of the six lettered word CASINO.

DETAILED DESCRIPTION OF THE INVENTION

Figures 1A, 1B, 2:
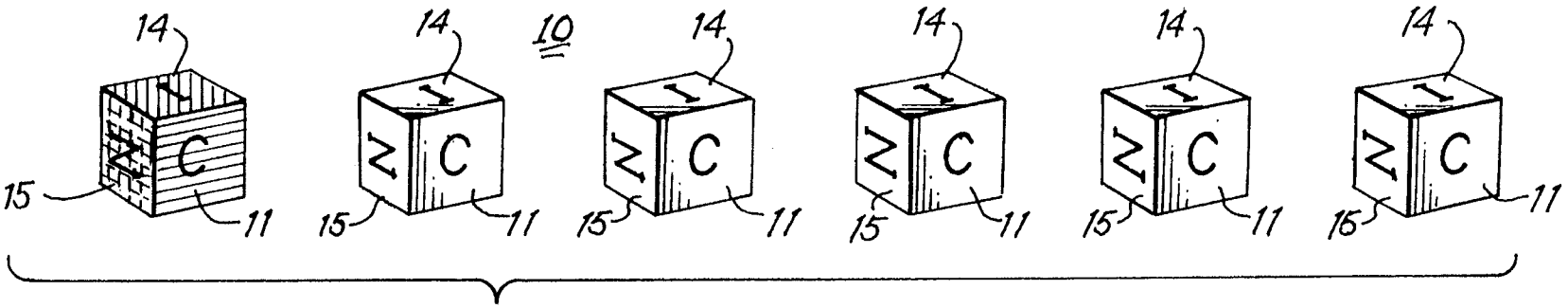
FIG. 1A—Perspective view of three faces of six identical dice cubes each of which has one letter of the word CASINO on each face. One die is shown in three different colors as an alternative mode.
FIG. 1B—Perspective view of the other three faces of the six dice of FIG. 1A. The other three faces are shown in three other different colors as an alternate mode.
FIG. 2—Perspective view of the six dice cubes spelling out the word CASINO on the front faces. As an alternate mode each front face of each die would be in a different color (not shown).

FIGS. 1 and 2 show perspective views of the six dice cubes 10 each having the word CASINO placed on their faces. The letters of the word CASINO are placed on the faces of the dice cubes 10 at the same relative position for each die. FIG. 1A shows that the faces 11 with the "C's" the faces 14 with the "I's" and the faces 15 with the "N's" are all at the same relative positions for each die. FIG. 1B shows faces 12 (A's), 13 (S's) and 16 (O's) of each of the six dice 10. The six cubes 10, therefore, are all identical to each other. Alternative to using the letters of a six lettered word, the dice may be made by placing a different one of six different colors on each face of each die. For example, face 11 blue (C), face 12 purple (A), face 13 orange (S), face 14 red (I), face 15 yellow (N), and face 16 green (O) may be used.

FIG. 2 is the perspective view which shows the word CASINO spelled out using all six cubes 10. The six cubes 10 of FIG. 2 show the following from a front perspective view: a "C" on face 11 of the first cube, an "A" on face 12 of the second cube, an "S" on face 13 of the third cube, an "I" on face 14 of the fourth cube, an "N" on face 15 of the fifth cube, and an "O" on face 16 of the sixth cube.

Each player rolls all six dice 10 in determining the order of play. The letters and combination of letters of the six dice 10 are assigned specific point values (as shown in the table below). The order from first to last player may be determined by the order of the highest to lowest point value respectively. In other words, the player who rolled the highest value would go first, and the player that rolled the lowest value would go last. In the event that there is a tie between certain players' rolls, those tying players then continue to roll the dice which had no point values showing until the tie is broken. Alternatively, the order of play may be determined by letting the player who scored highest go first, each other player taking his turn in order of seating arrangement.

After the order of play has been established, the point values for initial rolls only (i.e. whenever all six dice are rolled) will be scored as follows:

| | |
|---|---|
| C (Blue) = | 100 |
| O (Green) = | 100 |
| Three of a kind except three I's (Red) = | 500 |
| Three I's (Red) = | 1000 |
| Two sets of three of a kind = | 1000 |
| Three sets of two of a kind = | 1000 |
| Four of a kind except four I's (Red) = | 1000 |
| Four I's (Red) = | 1500 |
| Five of a kind except five I's (Red) = | 1500 |
| Five I's (Red) = | 2000 |
| Six of a kind except six I's (Red) = | 2000 |
| Six I's (Red) = | 2500 |
| C,A,S,I,N,O = | 3000 |

When all six dice are rolled, it is considered the first roll. All rolls of less than six dice are considered secondary rolls and only C's and O's have value on secondary rolls.

Alternatively, a similar scoring system could be simply devised based on the colors red, blue, green, yellow, orange and purple, for example.

The players are then required to roll the dice 10 to accumulate the point values according to the above scoring system. A player starts the game by "first rolling" all six dice 10. Each player must reach a threshold level of 1000 points in one complete turn in order to begin recording points to his score. After any initial roll, the player rolls only those dice 10 that show no point values for his subsequent or "secondary rolls" in which only C's or O's are counted (i.e. any dice 10 with point values are set aside.) The player forfeits his turn and loses his points for that turn if he rolls nothing of value during any roll during that turn. Therefore, a player's points are recorded only when that player's accumulated points reach the first predetermined number of 1000 points and that player surrenders his turn before he rolls nothing of value.

After the player rolls the dice 10 to the point where all of the dice 10 show point values, the player can then continue his turn by beginning with another "first roll" and continue with "secondary rolls". The player can continually repeat this process until he either desires to surrender his roll, or he rolls nothing of value in which case the player both loses his turn and his points for that turn.

This dice game will be continued by a player until he accumulates at least 10,000 points, which is the second predetermined number of points. At this time that player who rolls 10,000 points can choose to surrender his roll and win the game by establishing that player's score as the high score to be exceeded by the other players during their last turns to roll. Alternatively, that player with 10,000 points can choose to continue his turn by rolling the dice to further increase his final score and, in effect, make it more difficult for the other players to surpass that score and win the game. If the player with over 10,000 points, however, rolls nothing of value during that turn, then he will lose his turn and lose his points during that turn, and the winning high score would, therefore, not be established.

When a winning high score in excess of 10,000 points is established, then each of the players in turn are allowed to finish their last turn of the game. Each of these players in turn may exceed the present winning score so that he may be declared the new high score winner, and each of these remaining players may also choose to either end their last turn or risk losing the game by choosing to establish an even higher winning score. These remaining players, who choose to establish a higher winning score, will do this at the risk of rolling nothing of value and consequently losing the game.

The foregoing description of a preferred embodiment and best mode of the invention known to applicant at the time of filing the application has been presented for the purposes of illustration and description. It is not intended to be exhaustive or to limit the invention to the precise form disclosed, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method of playing a dice game for at least two players comprising the steps of:

(a) providing a set of six identical dice with a different symbol on each face of each die and a predetermined scoring system assigning a point value to individual and combined symbols appearing on predetermined rolls of the dice, and assigning no point values to selected ones of the other individual and combined symbols appearing on selected ones of the remaining possible rolls of the dice, (b) determining the order of play by the value of the roll of the dice by each player, (c) accumulating points for each player during his roll of the dice according to the scoring system which includes:

(1) beginning to record scores for each player in turn only after the player reaches a first predetermined number of points and surrenders his turn before he rolls nothing of value, without having to exceed the score of a previous player by a predetermined number of points, by first rolling all six of the dice and secondarily rolling only those dice that show no point value after the first roll, forefulling his turn and losing all his points for that turn if he rolls nothing of value during any roll during that turn, (d) allowing a player who reaches a second predetermined number of accumulated points to choose between ending his turn which establishes a winning score that needs to be exceeded by the remaining players in order for them to win and continuing his turn by rolling the dice to further increase his score, however losing his turn and losing his points accumulated during this turn if he rolls nothing of value and risking losing the establishment of the winning score, (e) allowing each of the succeeding players to finish their turn after a winning score has been established wherein they are provided the opportunity to exceed the winning score and, if the score is exceeded, then to choose between ending his turn which establishes a new winning score and continuing his turn to further increase his score to establish a new winning score wherein he risks losing the game, and (f) determining a winner of the game by the player who has the winning score that was not exceeded by any other player.

2. The method of playing a dice game for at least two players according to claim 1 wherein the step of determining the order of play comprises:

setting the order from first to last player according to the highest to lowest value of the dice rolled respectively by each player.

3. A method of playing a dice game for at least two players according to claim 1 wherein the step of determining the order of play comprises:

designating the player with the highest point value to start the game and each other player following in turn according to seating order.

4. The method of playing a dice game for at least two players according to claim 1 wherein the step of accumulating points further comprises:

continuing a player's turn to accumulate more points by rolling all six dice again if all six dice have points showing after the first roll or after the first and any secondary roll.

5. The method of playing a dice game for at least two players according to claim 1 wherein the secondarily rolling step further comprises:

counting for point value only predetermined ones of the dice faces.

6. The method of playing a dice game for at least two players according to claim 1 wherein the step of providing a set of six identical dice and a scoring system further comprises:

placing on each face of each die the letter of a six lettered word and the scoring system assigning various point values to various letters and combinations of letters.

7. The method of playing a dice game for at least two players according to claim 6 wherein the step of placing letters on the face of each die further comprises:

placing the letters of the six lettered word CASINO.

8. The method of playing a dice game for at least two players according to claim 1 wherein the step of providing a scoring system comprises:

| | |
|---|---|
| C = | 100 |
| O = | 100 |
| Three of any kind except three I's = | 500 |
| Three I's = | 1000 |
| 2 Threes of a kind = | 1000 |
| 3 sets of two of a kind = | 1000 |
| Four of a kind except four I's = | 1000 |
| Four I's = | 1500 |
| Five of a kind except five I's = | 1500 |
| Five I's = | 2000 |
| Six of a kind except six I's = | 2000 |
| Six I's = | 2500 |
| Spell the word CASINO = | 3000 |

9. The method of playing a dice game for at least two players according to claim 8 wherein the accumulating step further comprises:

counting only C's and O's on all rolls of less than six dice.

10. The method of playing a dice game for at least two players according to claim 8 wherein the step of beginning to record scores only after a player reaches a first predetermined number of points further comprises:

reaching 1,000 points.

11. The method of playing a dice game for at least two players according to claim 8 wherein the step of allowing a player who reaches a second predetermined set number of points further comprises:

reaching 10,000 points.

12. The method of playing a dice game for at least two players according to claim 1 wherein the step of providing a set of six identical dice and a scoring system further comprises:

placing a different one of six different colors on each face of a die and the scoring system assigning various point values to various colors and combinations of colors.

* * * * *

UNITED STATES PATENT AND TRADEMARK OFFICE

CERTIFICATE OF CORRECTION

PATENT NO. : 5,364,101

DATED : November 15, 1994

INVENTOR(S) : James J. Spooner, Kelley A. Spooner

It is certified that error appears in the above-indentified patent and that said Letters Patent is hereby corrected as shown below:

In the claims, Column 4, line 66, delete "forefulling" and substitute - - forfeiting - - .

Signed and Sealed this

Twenty-first Day of February, 1995

*Attest:*

Bruce Lehman

BRUCE LEHMAN

*Attesting Officer*

*Commissioner of Patents and Trademarks*